United States Patent [19]

Hill et al.

[11] Patent Number: 4,619,063

[45] Date of Patent: Oct. 28, 1986

[54] REVOLVING MAGAZINE FOR PISTOLS

[76] Inventors: Charles Hill; George Spector, both of 233 Broadway Rm 3615, New York, N.Y. 10007

[21] Appl. No.: 694,122

[22] Filed: Jan. 23, 1985

[51] Int. Cl.[4] ..... F41C 25/06
[52] U.S. Cl. ..... 42/7; 42/19
[58] Field of Search ..... 42/6, 7, 18, 19; 89/33.02

[56] References Cited

U.S. PATENT DOCUMENTS 2,997,924 8/1961 Rosebush ..... 42/19
3,167,876 2/1965 Milroy, Jr. ..... 42/7

*Primary Examiner*—Charles T. Jordan

[57] ABSTRACT

A pistol that has a barrel and bolt is provided and consists of a mechanism for revolving a cylindrical magazine that has a plurality of radial chambers which hold a plurality of cartridges within a cylindrical bore of a handle. Each chamber in turn will be in alignment with the barrel and the cartridges in turn will be in position to be pushed by the bolt to be fired from the barrel.

3 Claims, 9 Drawing Figures

REVOLVING MAGAZINE FOR PISTOLS

BACKGROUND OF THE INVENTION

The instant invention relates generally to handguns and more specifically it relates to a revolving magazine pistol.

Numerous handguns have been provided in prior art that are adapted to fire a considerable number of cartridges from rotatable chambers. For example, U.S. Pat. Nos. 65,742; 606,493 and 696,539 all are illustrative of such prior art. While these units may be suitable for the particular purpose to which they address, they would not be as suitable for the purposes of the present invention as heretofore described.

SUMMARY OF THE INVENTION

A principal object of the present invention is to provide a revolving magazine pistol that places a revolving magazine in the handle of the pistol to increase the amount of cartridges that can be fired from the pistol at one time.

Another object is to provide a revolving magazine pistol that can utilize either a four chamber or an eight chamber magazine which each chamber can hold ten cartridges each thus storing a greater number of cartridges within the magazine.

An additional object is to provide a revolving magazine pistol whereby the revolving magazine has a rotating top disc for quick loading and discharging of the cartridges.

A further object is to provide a revolving magazine pistol that is simple and easy to use.

A still further object is to provide a revolving magazine pistol that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
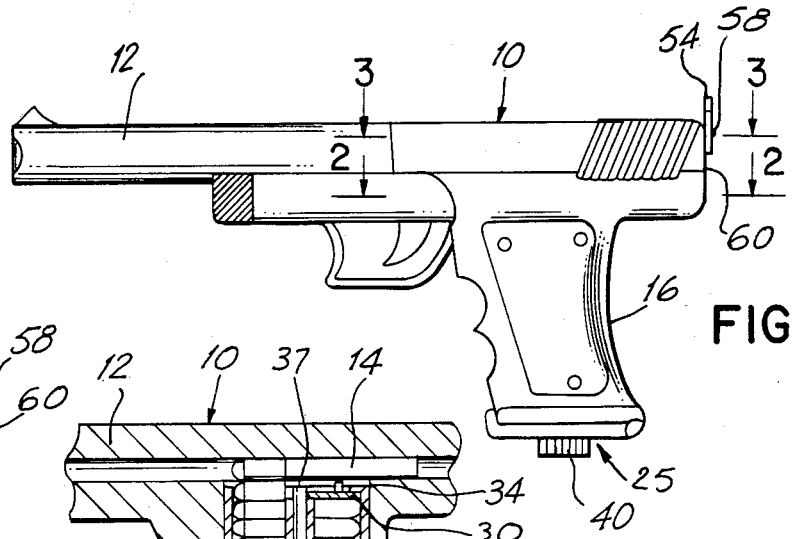
FIG. 1 is a side elevational view of a pistol equipped with the revolving magazine invention.

Turning now descriptively to the drawings, in which similar reference characters denote similar elements throughout the several views, FIGS. 1 through 6 illustrates a pistol 10 that has a barrel 12 and a bolt 14. The invention consists of a handle 16 that has a cylindrical bore 18 extending within. A cylindrical magazine 20 is removably secured within the bore 18 and has eight radial chambers 22. Each chamber 22 holds ten cartridges 24 for a total of eighty rounds. A device 25 is provided for revolving the magazine 20 within the bore 18 so that each chamber 22 in turn will be in alignment with the barrel 12 of the pistol. The cartridges 24 in turn will be in position to be pushed by the bolt 14 to be fired from the barrel 12.

Each chamber 22 of the magazine 20 contains at least one spring 26 placed at the bottom of the chamber and a follower 28 placed on top of the spring. The cartridges 24 sit one on top of each other on the follower 28 so that the spring 26 and the follower 28 can push the cartridges up.

A rotating disc 30 is mounted on top of the magazine 20. The disc 30 has a slot 32 to allow passage of the cartridges 24 to and from the chambers 22. An alignment pin 34 is mounted perpendicular to the disc 30 opposite the slot 32 so that the magazine 20 can be placed in a proper position within the bore 18 of the handle 16.

The device 25 for revolving the magazine 20 within the bore 18 consists of a loading rod 36 permanently mounted at 37 to top of the bore 18 of the handle 16 and extends downwardly. The magazine 20 has a central longitudinal aperture 38 so that the magazine can slide onto the loading rod 36. A knob 40 is affixed to the bottom of the magazine 20 so that the magazine can revolve around the loading rod 36 within bore 18.

The handle 16 further contains a magazine release holder 42 that has a central aperture 44. The holder 42 is pivotably connected at 46 to the bottom of the handle. A latch mechanism 48 is on the holder 42 to lock the holder to the bottom of the handle 16 so that the knob 40 can extend outwardly to be manually turned. Indications 50 and 52 are put on the knob 40 and the holder 42 so that the chambers 22 in the magazine 20 can be properly aligned.

Figure 8:
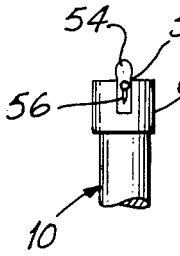
FIG. 8 is a partial end elevational view showing the adjustable peep sight.
Figure 4:
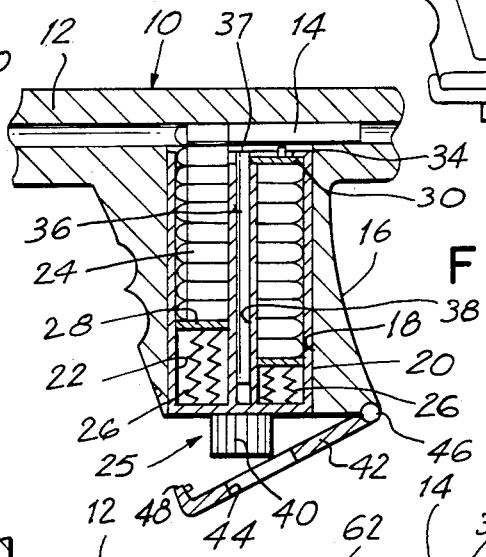
FIG. 4 is a cross sectional view taken along line 4—4 in FIG. 3 showing details of the revolving magazine.
Figure 7:
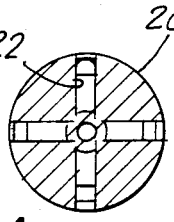
FIG. 7 is a transverse cross sectional view of a four chamber revolving magazine.
Figure 2:
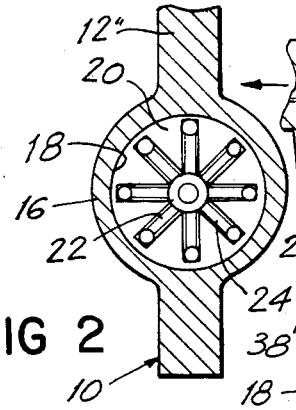
FIG. 2 is a cross sectional view taken along line 2—2 in FIG. 1 showing the revolving magazine with eight chambers.

FIG. 7 shows a modified magazine 20 that has four chambers 22 instead of eight. This magazine works the same way as the magazine 20 with eight chambers 22 shown in FIG. 2. A peep sight 54 shown in FIGS. 1 and 8 has a slot 56 and screw 58 for adjustment purposes and is used for sighting targets and the like. The peep sight 54 is on side 60 of the pistol 10.

Figure 9:
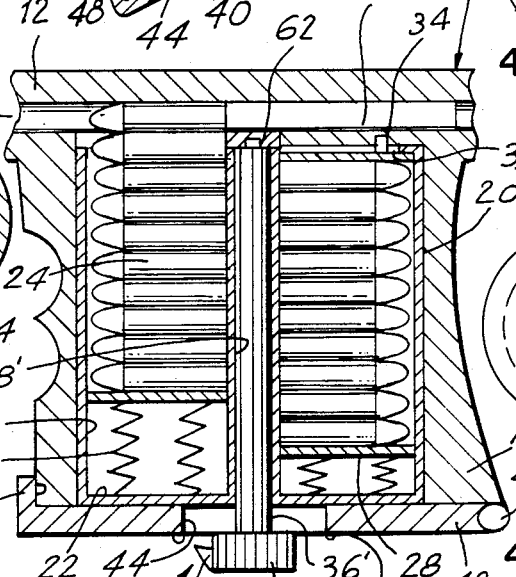
FIG. 9 is a cross sectional view similar to FIG. 4 showing a modified revolving magazine.
Figure 3:
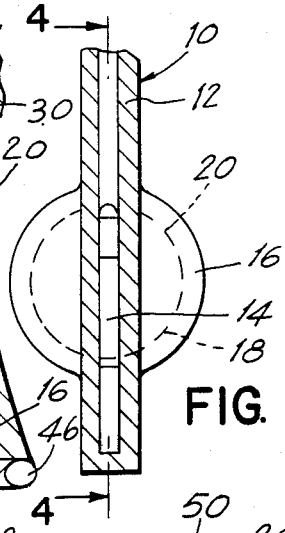
FIG. 3 is a cross sectional view taken along line 3—3 in FIG. 1 showing a cartridge being fed into the barrel.
Figure 5:
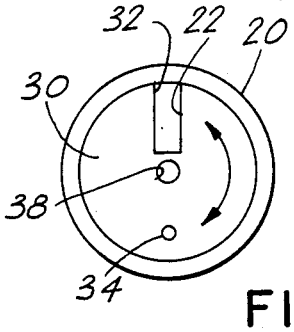
FIG. 5 is a top view of the revolving magazine showing a rotating disc for loading the cartridges within.
Figure 6:
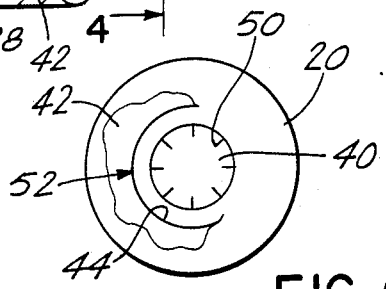
FIG. 6 is a bottom view of the revolving magazine and part of magazine release holder with indications on the knob for chamber alignment.

FIG. 9 shows a modification of device 25 for revolving the magazine 20 within the bore 18. The magazine 20 has a central longitudinal splined aperture 38' therethrough. A splined loading rod 36' that has a knob 40 is provided. The loading rod 36' extends through the aperture 38' in the magazine 20 and is removably mounted at 62 to the top of the bore 18 of the handle 16. When the knob 40 is manually turned the magazine 20 can revolve within the bore 18.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pistol having a barrel and bolt which comprises:

(a) a handle having a cylindrical bore extending within;

(b) a cylindrical magazine having a plurality of radial chambers wherein said chambers can hold a plurality of cartridges, said magazine is removeably secured within said bore;

(c) means for revolving said magazine within said bore so that each chamber in turn will be in alignment with said barrel of said pistol and said cartridges in turn will be in position to be pushed by said bolt and fired from said barrel, wherein each said chamber of said magazine comprises:

(d) at least one spring placed at bottom of said chamber;

(e) a follower placed on top of said spring with said cartridges sitting one on top of each other on said follower so that said spring and said follower can push said cartridges up, wherein said magazine further comprises:

(f) a rotating disc mounted on top of said magazine, said disc having a slot to allow passage of said cartridges to and from said chambers;

(g) an alignment pin mounted perpendicular to said disc opposite said slot so that said magazine can be placed in a proper position within said bore of said handle, wherein said means for revolving said magazine within said bore comprises:

(h) a loading rod mounted to top of said bore of said handle and extending downwardly;

(i) said magazine having a central longitudinal aperture so that said magazine can slide onto said loading rod;

(j) a knob affixed to bottom of said magazine so that said magazine can revolve around said loading rod within said bore.

2. A pistol as recited in claim 1, wherein said means for revolving said magazine within said bore comprises:

(a) said magazine having a central longitudinal splined aperture therethrough; and (b) a splined loading rod having a knob at the bottom, said loading rod extends through said aperture in said magazine and is removeably mounted to top of said bore of said handle so that when said knob is manually turned said magazine can revolve within said bore.

3. A pistol as recited in claim 2, wherein said handle further comprises:

(a) a magazine release holder having a central aperture, said holder pivotally connected to bottom of said handle;

(b) a latch mechanism on said holder to lock said holder to bottom of said handle so that said knob can extend outwardly to be manually turned; and (c) indications on said knob and said holder so that said chambers in said magazine can be properly aligned.

* * * * *